United States Patent [19]

Bubik et al.

[11] 4,417,950

[45] Nov. 29, 1983

[54] PAPERMAKING MACHINE CONTAINING TWO MOVABLE WATER PERVIOUS DEWATERING BANDS

[75] Inventors: Alfred Bubik, Ravensburg; Kurt Hack, Vorberg, both of Fed. Rep. of Germany

[73] Assignee: Escher Wyss GmbH, Ravensburg, Fed. Rep. of Germany

[21] Appl. No.: 321,677

[22] Filed: Nov. 16, 1981

[30] Foreign Application Priority Data

Nov. 26, 1980 [CH] Switzerland ..... 8746/80

[51] Int. Cl.[3] ..... D21F 1/40

[52] U.S. Cl. ..... 162/300; 162/352

[58] Field of Search ..... 162/203, 300, 301, 352

[56] References Cited

U.S. PATENT DOCUMENTS

| | | | |
|---|---|---|---|
| 3,150,037 | 9/1964 | Lee | 162/208 |
| 3,726,758 | 4/1973 | Parker et al. | 162/203 X |
| 3,994,774 | 11/1976 | Halme | 162/301 X |
| 4,100,018 | 7/1978 | Wahren et al. | 162/301 X |
| 4,176,005 | 11/1979 | Bubik et al. | 162/300 X |
| 4,209,360 | 6/1980 | Stenberg et al. | 162/203 |

FOREIGN PATENT DOCUMENTS

| | | | |
|---|---|---|---|
| 347774 | 1/1979 | Austria . | |
| 2411739 | 9/1974 | Fed. Rep. of Germany . | |
| 2557146 | 9/1976 | Fed. Rep. of Germany | 162/300 |
| 2716598 | 10/1977 | Fed. Rep. of Germany . | |

*Primary Examiner*—Richard V. Fisher

*Attorney, Agent, or Firm*—Werner W. Kleeman

[57] ABSTRACT

A double sieve or twin-wire papermaking machine possesses a substantially planar section of a lower band which is equipped with a headbox. Furthermore, it contains a shoe containing a domed surface and a dewatering cylinder. Arranged after the dewatering cylinder is a deflection roll which is located at the side of both bands, typically in the form of sieves, wires or filters, which face away from the dewatering cylinder. The shoe and the dewatering cylinder are located either within the lower band or within the upper band. The first deflection roll can have arranged thereafter a second deflection roll which is located at the same side of the lower band as the dewatering cylinder.

14 Claims, 8 Drawing Figures

1
2
3
4
5
6
7
8
10
11
12
13
14
15
16
17
18
20
21
22
23
A
B
S
R1
R2
α
β

PAPERMAKING MACHINE CONTAINING TWO MOVABLE WATER PERVIOUS DEWATERING BANDS

BACKGROUND OF THE INVENTION

The present invention broadly relates to the papermaking art, and, more specifically, concerns a new and improved construction of a papermaking machine containing two movable water pervious dewatering bands, for instance sieves or wires.

Generally speaking, the papermaking machine of the present development is of the type wherein one of the bands, the lower band, contains an essentially horizontally extending and substantially flat or planar section which is equipped with a headbox for the infeed of a fiber stock suspension onto the lower band. Additionally, there is provided a shoe having a domed or arched surface over which there is guided at least one of the bands, and a dewatering cylinder is arranged after the shoe. Both of the bands are conjointly guided over the dewatering cylinder along a portion of its circumference, and the shoe is arched or domed such that it posesses a larger radius of curvature than the dewatering cylinder.

A papermaking machine of this type is known in this art, for instance, from U.S. Pat. No. 4,176,005, granted Nov. 27, 1979. The double sieve or filter papermaking machine disclosed in the aforementioned U.S. Pat. No. 4,176,005—also sometimes referred to in the art as a twin-wire type of papermaking machine—affords a particularly favorable course of the dewatering of a fiber web which is formed upon one of the sieves or wires in that its intensity can be increased in steps or stages, initially at a flat or planar section, then at a section working with a suction action, a domed or arched shoe and finally at a dewatering cylinder. Additionally, at the region of the shoe and the dewatering cylinder there can be provided mechanical regulation expedients for the purpose of controlling the dewatering intensity.

SUMMARY OF THE INVENTION

It is a primary object of the present invention to improve upon the prior art papermaking machine disclosed in the aforementioned U.S. Pat. No. 4,176,005, and specifically with the objective of further enhancing the dewatering action and the sheet formation, with simultaneous modification of the construction of the machine so that it approaches the heretofore known longitudinal sieve or wire machines.

Another important object of the present invention and in keeping with the previously mentioned object is to convert longitudinal wire machines through the use of very simple means in a manner such that their output or production capacity can be increased.

Yet a further significant object of the present invention is directed to the construction of a new and improved papermaking machine which selectively can operate as a double sieve or filter papermaking machine according to the principles of the aforementioned U.S. Pat. No. 4,176,005 or as longitudinal wire or sieve papermaking machines.

Now in order to implement these and still further objects of the invention, which will become more readily apparent as the description proceeds, the papermaking machine of the present development is manifested by the feature that, viewed with respect to the direction of movement of the bands, there is arranged after the dewatering cylinder a deflection roll which is located at the side of both hands which faces away from the dewatering cylinder. Both of the bands are likewise conjointly guided over the deflection roll along a portion of its circumference in a manner such that the deflection roll enables changing the direction of the bands in an opposite sense to the deflection accomplished by the dewatering cylinder.

By practicing the teachings of the invention there can be realized a papermaking machine having a low structural height and a simple construction, the dewatering action of which is further improved by the deflection roll in relation to the papermaking machine disclosed in the aforementioned U.S. Pat. No. 4,176,005. On the one hand, by virtue of the action of the deflection roll there is increased the wrap angle at the dewatering cylinder, and, on the other hand, there is additionally obtained at the deflection roll a further dewatering location which functions in the same manner as at the dewatering cylinder. With the flat or planar section there is obtained a pre-dewatering path which enables using a shoe having a relatively modestly domed or arched surface and which nonetheless renders possible the strived for effect during the running-in or contact of the fiber web at the region between both of the bands or sieves and at the dewatering cylinder. Due to the deflection of the band or sieve by means of the deflection roll there is obtained a construction which is comparable or similar to a longitudinal sieve or wire papermaking machine and affords the aforementioned advantages of conversion or alteration of such paper-making machine into a longitudinal sieve papermaking machine.

The shoe and the dewatering cylinder can be located within the lower water pervious band or sieve, and the deflection roll can be arranged within the upper water pervious band or sieve. This construction is particularly suitable for those instances where there should be provided a relatively large dewatering cylinder and where at the same time there is contemplated lifting-off of the deflection roll for the purpose of converting the equipment to a longitudinal sieve paper-making machine.

However, the deflection roll also can be arranged within the lower water pervious band, and the shoe and the dewatering cylinder are located within the upper water pervious band. This constructional design, in turn, affords the advantage of improved dewatering in an upward direction in addition to the dewatering action in a downward direction.

In both instances it is advantageous to provide the lower water pervious band with dewatering devices which are arranged forwardly of the shoe.

However, such conventional measures do not constitute any absolute requirements since, in many instances, dewatering through the band or sieve for itself can be totally adequate.

The upper band can be raised along with its guide elements and dewatering elements from the lower band. Consequently, with certain designs of the invention there is obtained the possibility of converting the equipment from a double filter or sieve papermaking machine to a longitudinal sieve or filter papermaking machine and vice-versa.

The lower band can be provided with additional dewatering devices following the dewatering cylinder and the deflection roll.

A second deflection roll can be arranged after the deflection roll and which is located at the same side of the water pervious bands as the dewatering cylinder and over which there is guided at least one of the water pervious bands. This second deflection roll can be a suction roll.

If the second deflection roll along with its surface is located in the plane of the course or path of travel of the water pervious band and forwardly of the shoe and if there extends thereafter the water pervious band in the same plane as forwardly of the shoe then upon raising of the upper band there is obtained a standard longitudinal sieve papermaking machine.

It should be understood that the aforementioned water pervious bands, as a general rule, can be constituted by sieves or filters, also referred to in the art as wires. However, it is also conceivable to use for instance felts.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
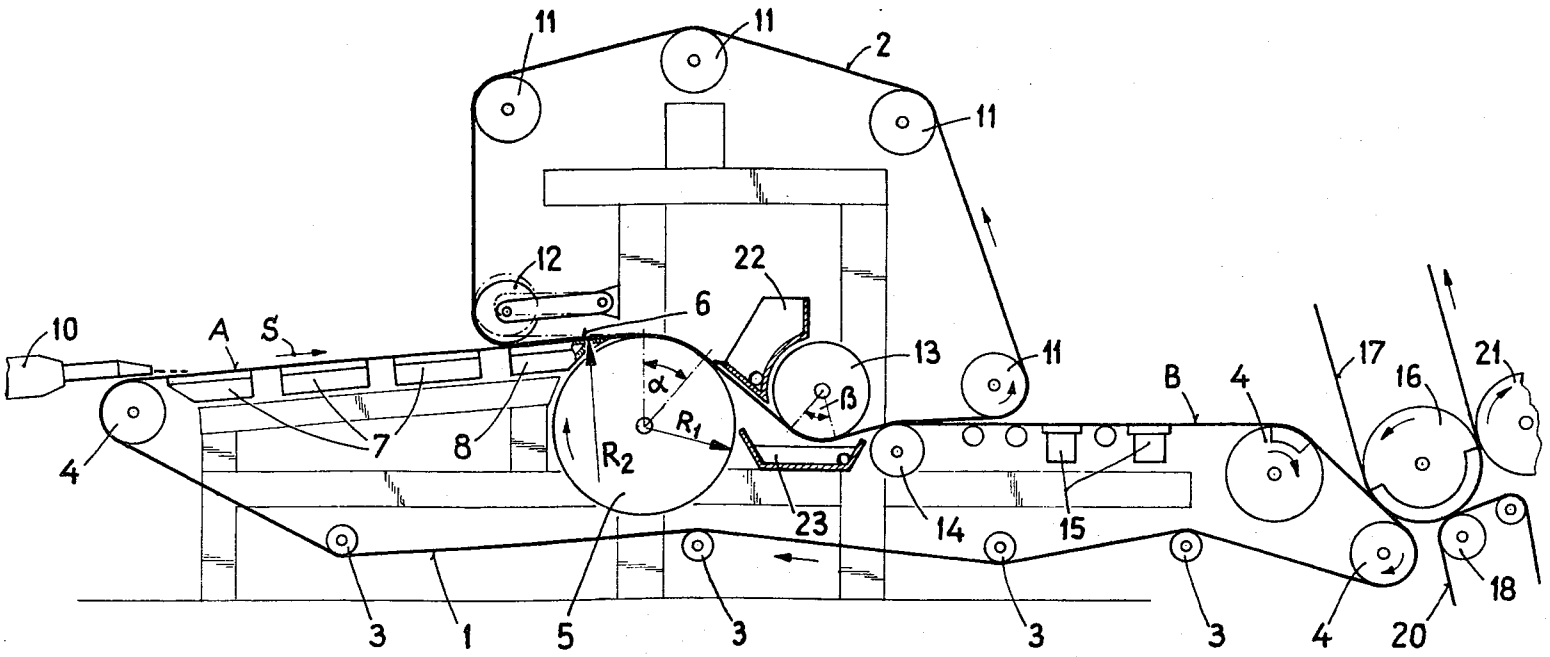
FIG. 1 illustrates a first exemplary embodiment of a papermaking machine containing a shoe and dewatering cylinder at a lower sieve or wire.

Describing now the drawings, it is to be understood that throughout the various figures thereof there has only been shown enough of the details of the papermaking machine to enable those skilled in the art to readily understand the underlying principles and concepts of the present development. Turning attention now specifically to the exemplary embodiment of papermaking machine illustrated in FIG. 1 it will be seen that such possesses a lower wire or sieve band 1 and an upper wire or sieve band 2. Within the lower sieve band 1, which is trained about guide rolls 3 and guide cylinders 4, there is located a dewatering cylinder 5 possessing a radius $R_1$. Arranged directly forwardly or upstream of the dewatering cylinder 5 is a dewatering shoe 6 containing a domed cylindrical surface having a radius $R_2$. As will be clearly evident by inspecting FIG. 1 the radius $R_2$ is appreciably larger than the radius $R_1$. The construction of the dewatering shoe 6 and the dewatering cylinder 5 may be essentially like that disclosed in the double filter papermaking machine described in the aforementioned U.S. Pat. No. 4,176,005, to which reference may be readily had and the disclosure of which is incorporated herein by reference.

With respect to the direction of movement of the sieve or wire 1, which has been indicated conveniently by an arrow S, there is located forwardly of the dewatering shoe 6 a substantially flat or planar section A which is provided with dewatering elements 7, such as typically for instance foils and suction boxes. Also the dewatering shoe 6 can be equipped with a suction box 8 in the manner disclosed in the mentioned U.S. Pat. No. 4,176,005. At the start or initial portion of the planar section A there is located a headbox 10 or equivalent structure which, in known manner, serves for the distribution of the stock suspension onto the sieve or wire 1 and for forming a fiber web upon such sieve or wire 1.

Above the sieve 1 there is located the sieve or wire 2 which is guided over guide rolls 11, an adjustment roll 12 and a deflecton roll 13. The adjustment roll 12 serves, in the manner known from U.S. Pat. No. 4,176,005, for adjusting the run-on or contact point of the upper sieve or wire 2 at the lower sieve or wire 1 at the region of the dewatering shoe 6 and the dewatering cylinder 5, respectively. The deflection roll 13 is entrained by both sieves or wires 1 and 2 conjointly at a contact surface thereof along its circumferential angle $\beta$ and thus simultaneously ensures that the sieves or wires 1 and 2 will wrap about the dewatering cylinder 5 through a wrap angle $\alpha$. As shown in FIGS. 1–6, the contact surface of the deflection roll 13 is located, during operation of the papermaking machine, totally within a projection of the height of the dewatering cylinder. The contact surface may be located near the center of the projection of the dewatering cylinder, and it may be located in either the upper or lower region of the deflection roll 13 which is located within the projection of the height of the dewatering cylinder.

With the exemplary embodiment of papermaking machine illustrated in FIG. 1 there is arranged following the deflection roll 13, i.e. downstream of such deflection roll 13, a second deflection roll 14 which simultaneously serves as a separation roll for separating both of the sieves or wires 1 and 2 from one another. Following the second deflection roll 14 the sieve or wire 1 possesses a second substantially flat or planar section B which is equipped with suitable dewatering devices, such as for instance suction boxes 15. Finally, the sieve or wire 1 is equipped with a suction press roll 16 containing a felt band 17 for the pick-up or removal of the paper web from the sieve or wire 1. The suction press roll 16 cooperates with a counter-roll 18 containing a sieve 20 as well as with a counter-roll 21.

The dewatering cylinder 5 and the deflection roll 13 have operatively correlated therewith, as shown in FIG. 1, catch or receiver containers or vats 22 and 23 for collecting the filtered or sieved water.

With the papermaking machine shown by way of example in FIG. 1 the dewatering of the fiber web which is formed by the fiber stock suspension deposited by the headbox 10, is accomplished in conventional manner initially at the substantially flat section or portion A, and specifically, preferably with increasing intensity or vigourness. Thereafter, the formed fiber web, depending upon the position of the adjustment roll 12, arrives at the region of the dewatering shoe 6 or the dewatering cylinder 5 between both of the sieves or wires 1 and 2, whereby there is obtained a further increase in the dewatering intensity. If the sieve or wire 2 comes into contact with the fiber web and the lower sieve or wire 1, by virtue of the corresponding adjustment of the adjustment roll 12 already at the dewatering shoe 6, then also at this region there is obtained an increasing intensity of the dewatering action which is favorable for the formation of the paper web. As concerns details in this respect reference is again made to the aforementioned U.S. Pat. No. 4,176,005.

Following the dewatering cylinder 5 both of the sieves or wires 1 and 2 are conjointly deflected by the action of the deflection roll 13 through the wrap angle $\beta$ in the opposite sense to the deflection accomplished by the dewatering cylinder 5 (angle $\alpha$), so that they now extend essentially in the direction of the inlet section or portion A, in contrast to the papermaking machine of the aforementioned U.S. Pat. No. 4,176,005. After a further dewatering action at the substantially planar section or portion B the then formed paper web is picked-up or lifted-off by the roll 16 from the sieve or wire 1 and transferred to a press unit which contains the rolls 16, 18 and 21.

With the embodiment of papermaking machine according to the invention and as shown in FIG. 1 there are obtained large wrap angles $\alpha$ and $\beta$ at the dewatering cylinder 5 and the deflection roll 13, respectively. These large wrap angles $\alpha$ and $\beta$ are favorable for the dewatering action, notwithstanding the essentially horizontal extent of the papermaking machine which therefore is quite similar to a conventional longitudinal sieve papermaking machine. Therefore, it is possible to accomplish the aforementioned restructuring or conversion of the equipment with the aid of very simple means.

Figure 2:
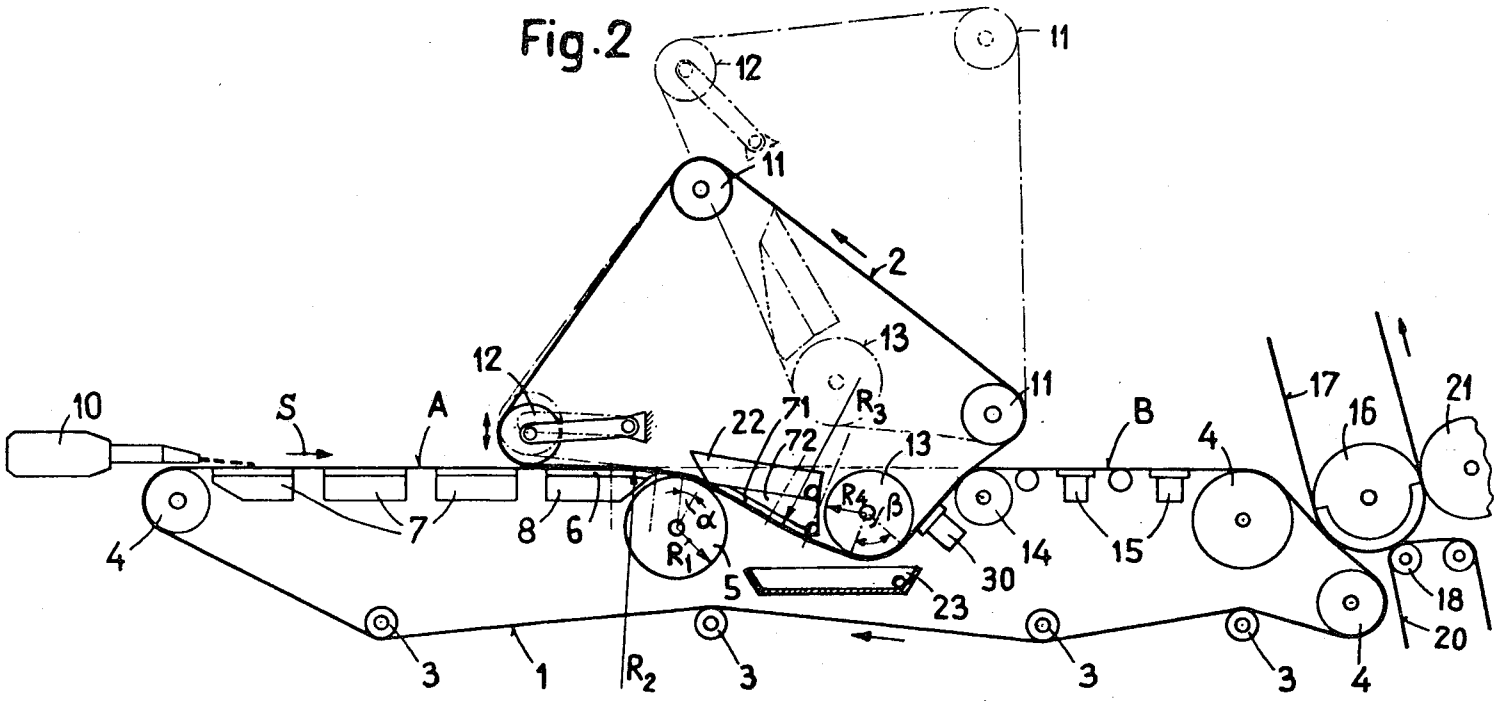
FIG. 2 illustrates a papermaking machine which in principle is similar to the papermaking machine of FIG. 1, wherein however the course of the lower sieve or wire before and after the dewatering cylinder and the deflection roll is located in one plane.

Continuing with the modified construction of papermaking machine disclosed in FIG. 2 it is to be understood that for convenience in the description and illustration corresponding or analogous components have been generally designated with the same reference characters as used for the arrangement of papermaking machine described above in conjunction with FIG. 1. Also the function of this embodiment of papermaking machine is the same as the papermaking machine of FIG. 1.

One of the major differences between both embodiments of papermaking machines as disclosed in FIGS. 1 and 2, respectively, resides in the fact that with the papermaking machine of FIG. 2 both of the sections or portions A and B are located in one plane, which also requires a corresponding position of the second deflection roll 14. Consequently, this construction of papermaking machine is even more similar to a longitudinal sieve papermaking machine than the equipment design of FIG. 1, wherein the section or portion A is located higher than the section or portion B and is somewhat upwardly inclined, in order to thus obtain a corresponding size or magnitude of the wrap angle $\alpha$.

In corresponding manner, also with the embodiment of papermaking machine as disclosed in FIG. 2 there is possible a simple conversion of the double sieve or filter papermaking machine into a longitudinal sieve papermaking machine, and this has been indicated by the phantom or chain-dot lines in conjunction with the upper sieve or wire 2.

As also will be evident by reverting to FIG. 2, there is located a suction box 30 between the first deflection roll 13 and the second deflection roll 14 below the sieve or wire 1. This suction box 30 has assigned thereto two different tasks in accordance with the illustrations of FIGS. 3 and 4 which are detail showings on an enlarged scale in relation to the illustration of FIG. 2.

Figure 4:
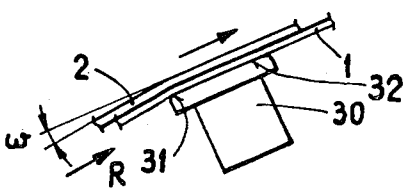
FIGS. 3 and 4 illustrate respective details of the papermaking machine shown in FIG. 2.
Figure 3:
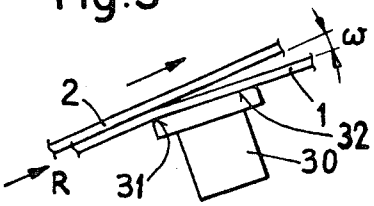

As will be readily seen by referring to FIGS. 3 and 4, the upper surface 32 of the suction box 30 is inclined in relation to the direction R of the sieve or wires 1 and 2 through a small angle $\omega$ of approximately 1° forwardly of the suction box 30. In accordance with the illustration of FIG. 3 there is obtained by the forward edge 31 a separation of both sieves or wires 1 and 2. This of course presupposes a corresponding positioning of the second deflection roll 14 in relation to the suction box 30 and the upper guide roll 11.

With the embodiment of FIG. 2 both of the sieves or wires 1 and 2 are conjointly drawn over the edge 31 of the suction box 30. In this case there is obtained by means of the action of the edge 31 a so-called drainage effect, by means of which both of these sieves or wires are mutually shifted and there is obtained a smoothing of the formed paper web.

Figure 5:
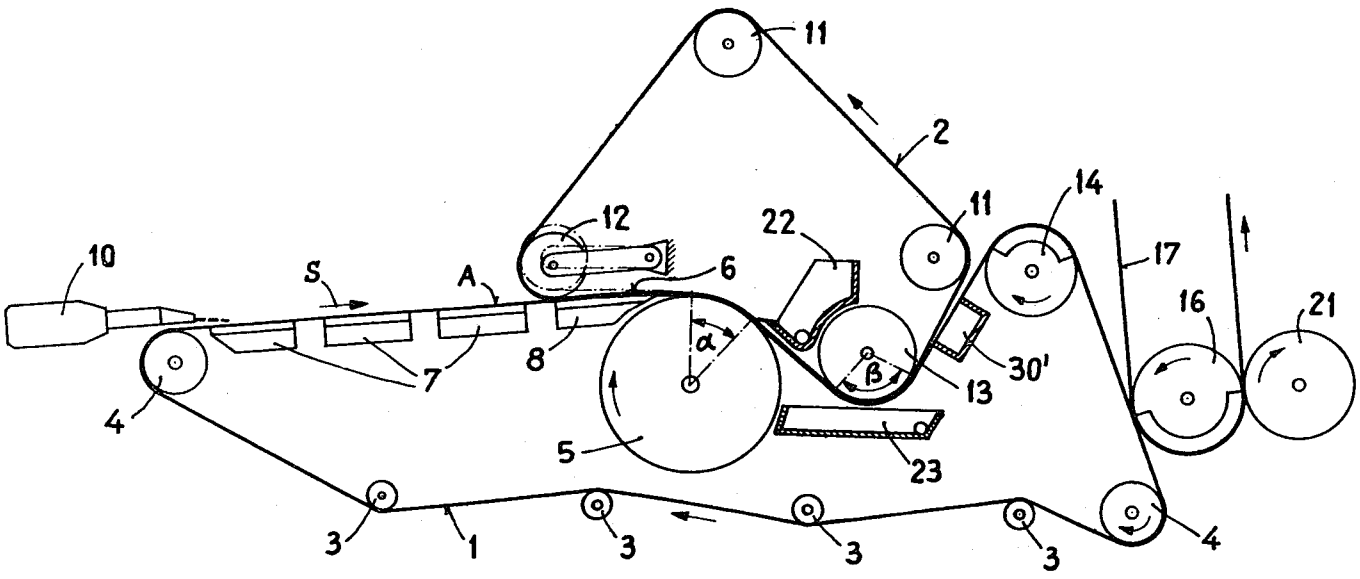
FIG. 5 illustrates a further exemplary embodiment of a papermaking machine containing a dewatering cylinder and shoe located internally of the lower sieve or wire and with a larger wrap angle of the dewatering cylinder and the deflection roll.

FIG. 5 illustrates an exemplary embodiment of inventive papermaking machine which contains within the sieve or wire 1 a dewatering cylinder 5 and dewatering shoe 6, where there are realized particularly large wrap angles $\alpha$ and $\beta$ by suitably guiding the sieves or wires 1 and 2. With the embodiment of papermaking machine shown in FIG. 5 the second deflection roll 14 is constituted by a suction roll forwardly of which there can be arranged a suction box 30' which corresponds to the suction box 30 shown in the arrangement of FIG. 2.

Figure 6:
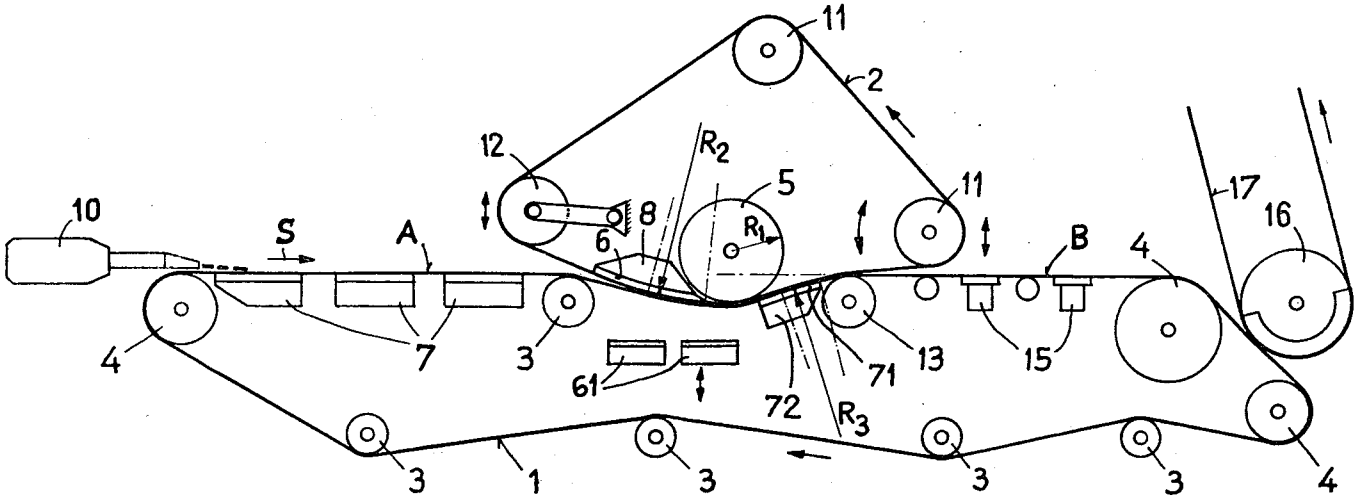
FIG. 6 illustrates a papermaking machine corresponding essentially to the construction of machine shown in FIG. 2, wherein however the dewatering cylinder and the shoe are located within the upper sieve or wire.

Continuing, with the exemplary embodiment of papermaking machine depicted in FIG. 6 the dewatering shoe 6 and the dewatering cylinder 5 are located within the upper sieve or wire 2. Since in this case an appreciable part of the dewatering action of the web located upon the wire or sieve 1 is accomplished in an upward direction, it is desirable to provide the dewatering shoe 6 with a suction box and to construct the dewatering cylinder 5 as a suction cylinder.

Figure 7:
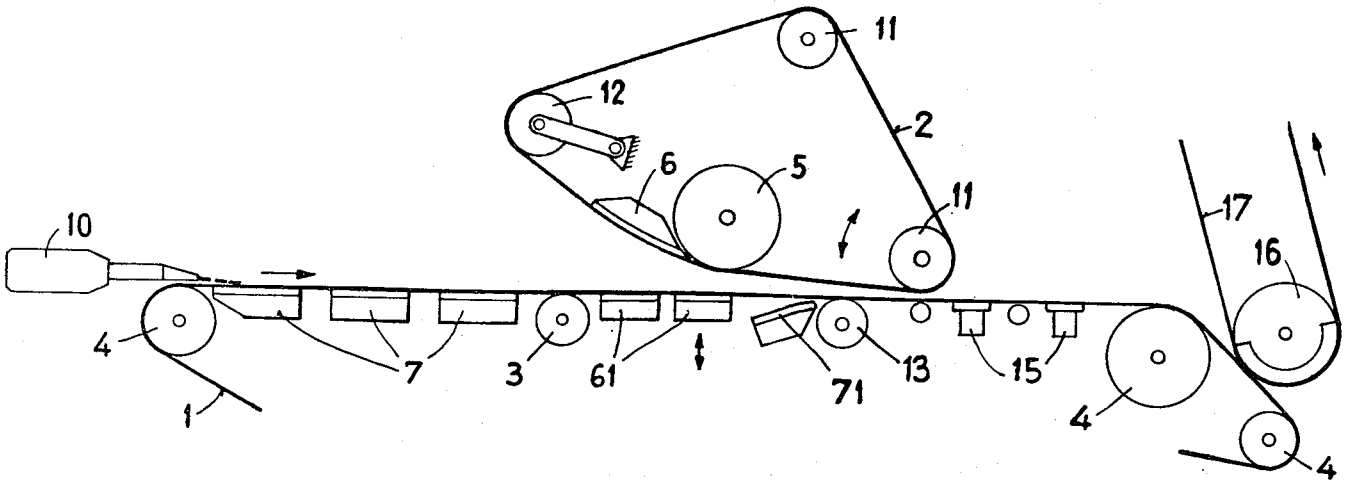
FIG. 7 illustrates the papermaking machine of FIG. 6 with the upper sieve or wire raised.

FIG. 7 illustrates the papermaking machine protrayed in FIG. 6 but with the upper sieve or wire 2 raised, this wire 2 being pivoted about the right-hand depicted guide roll 11. Consequently, the inventive double-sieve or twin-wire papermaking machine is easily converted into a simple longitudinal sieve papermaking machine. In addition to the upward pivoting of the wire or sieve 2 with the dewatering devices located therein, namely the dewatering shoe 6 and the dewatering cylinder 5, there are also upwardly shifted the suction boxes 61, as best shown in FIG. 6, which are located at this region below the wire or sieve 1 until such contact this sieve or wire, as will be clearly apparent by referring to FIG. 7.

Figure 8:
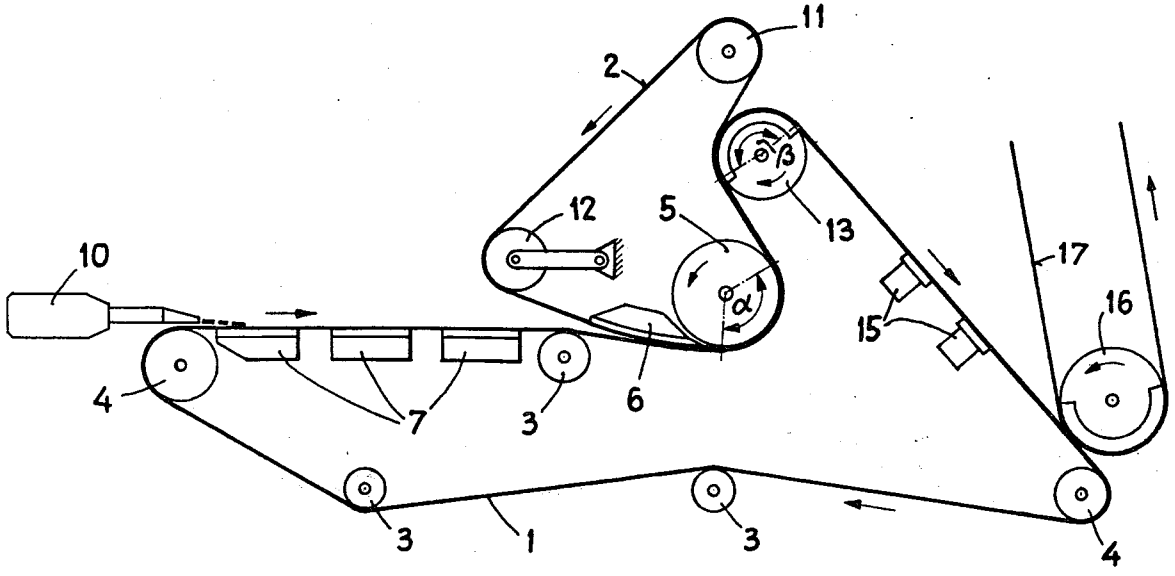
FIG. 8 illustrates an exemplary embodiment of papermaking machine with a dewatering cylinder and shoe located within the upper sieve or wire and with a greater angle of wrap of the dewatering cylinder and the shoe.

Finally, FIG. 8 illustrates an embodiment of papermaking machine which is similar to that disclosed in conjunction with FIGS. 6 and 7, wherein the first deflection roll 13 is arranged above the dewatering cylinder 5 and is constructed as a suction roll. This exemplary embodiment of papermaking machine affords the advantage that there can be attained large wrap angles $\alpha$ and $\beta$ at the dewatering cylinder 5 and at the deflection roll 13, respectively.

In all of the exemplary embodiments disclosed herein it is possible for the dewatering cylinder 5 to either be constructed as a solid dewatering cylinder or as a suction cylinder. Also the dewatering shoe 6 can possess a solid surface and/or openings or slots and can be connected with a suction box or equivalent structure. In this regard reference is again made to the aforementioned U.S. Pat. No. 4,176,005.

The dewatering shoe 6 can be constructed in conventional manner to be either open, closed or can have both designs, i.e. can possess a solid surface and a region having openings. Preferably, the dewatering shoe 6 can be connected with a suction box in accordance with the teachings of U.S. Pat. No. 4,176,005, something which however is not an absolute requirement.

In comparable manner the dewatering cylinder or roll 5, the first deflection roll 13 or the second deflection roll 14 can be designed to be closed, open or in fact equipped with a vacuum, i.e. constructed as suction rolls.

With the exemplary embodiment of papermaking machine as disclosed in FIG. 1 the plane of the section or portion A need not be located higher than the plane of the section or portion B. Conversely, the plane of the section B can be located at a greater elevation than that of the section A when there is provided a suitable arrangement of the rolls 5, 13 and 14.

Finally, with the exemplary embodiments of papermaking machines as disclosed in FIGS. 6, 7 and 8 the guide roll 3 located forwardly of the dewatering shoe 6 can be dispensed with or can be replaced by a further dewatering element in the manner of the suction boxes 7.

As will be apparent from FIGS. 2, 6 and 7 there can be arranged following the dewatering cylinder 5 also a shoe 71 which is arranged at the side of both wires or sieves 1 and 2 facing away from the dewatering cylinder 5. The shoe 71 may be similarly constructed like the shoe 6 and possesses a substantially cylindrical guide surface, the radius $R_3$ of which is greater than the radius $R_4$ of the deflection roll 13. The shoe 71 likewise can be provided with a pervious surface and with a suction box 72. Hence, the dewatering intensity is further increased at the region of the dewatering cylinder 5. With the embodiment according to FIG. 2 the dewatering occurs upwardly under the influence of the suction box 72, so that the properties of both sides of the paper web are rendered relatively uniform or essentially the same.

While there are shown and described present preferred embodiments of the invention, it is to be distinctly understood that the invention is not limited thereto, but may be otherwise variously embodied and practiced within the scopy of the following claims. ACCORDINGLY,

What we claim is:

1. A papermaking machine comprising:

two movable water pervious dewatering bands defining a lower band and an upper band;

said lower band possessing an essentially horizontally extending and essentially planar band portion;

a headbox cooperating with said substantially planar band portion for the infeed of a fiber stock suspension for deposition onto the lower band;

a dewatering shoe having a domed surface over which there can be guided at least one of said bands;

a dewatering cylinder arranged after the dewatering shoe with respect to the direction of travel of both of said bands and over which both of said bands are conjointly guided over a portion of the circumference of said dewatering cylinder;

the domed surface of said dewatering shoe possessing a larger radius of curvature than the radius of curvature of said dewatering cylinder;

a deflection roll arranged following the dewatering cylinder with respect to the direction of movement of said bands;

said deflection roll being located at the side of both bands which faces away from said dewatering cylinder;

both of said bands being conjointly guided over said deflection roll throughout a portion of the circumference of said deflection roll at a contact surface thereof in a manner such that due to the action of said deflection roll there can be altered the direction of the bands in a sense opposite to the deflection of the bands which is accomplished by the dewatering cylinder;

said contact surface of said deflection roll for both of said bands being located, during operation of the papermaking machine, totally within a projection of the height of the dewatering cylinder; and means for deflecting the lower band at a location following said deflection roll so as to cause said lower band following said deflection roll to travel essentially horizontally towards an outfeed end of the papermaking machine and in a direction corresponding essentially to the direction of said horizontally extending and essentially planar band portion of the lower band cooperating with said headbox, so that the lower band essentially maintains a horizontal direction of extent throughout the papermaking machine in order to have said lower band essentially maintain a configuration comparable to a lengthwise extending band of a longitudinal papermaking machine.

2. The papermaking machine as defined in claim 1, wherein:

said dewatering shoe and said dewatering cylinder are located within the lower water pervious band; and said deflection roll being arranged within the upper water pervious band.

3. The papermaking machine as defined in claim 1, wherein:

said deflection roll is arranged within the lower water pervious band; and said dewatering shoe and said dewatering cylinder being located within the upper water pervious band.

4. The papermaking machine as defined in claim 1, further including:

dewatering devices provided for the lower water pervious band and arranged forwardly of said dewatering shoe.

5. The papermaking machine as defined in claim 1, further including:

means for guiding said upper band;

dewatering elements provided for said upper band; and said upper band together with said guide means and said dewatering elements being capable of being lifted-off said lower band.

6. The papermaking machine as defined in claim 1, further including:

dewatering devices provided for the lower band following the dewatering cylinder and said deflection roll.

7. The papermaking machine as defined in claim 1, wherein said means for deflecting includes:

an additional deflection roll being located at the same side of the water pervious bands as said dewatering cylinder; and at least one of the water pervious bands being guided over said additional deflection roll.

8. The papermaking machine as defined in claim 7 wherein:

said additional deflection roll is structured as a suction roll.

9. The papermaking machine as defined in claim 7, wherein:

said additional deflection roll has a surface located essentially in a plane through which travels the lower water pervious band forwardly of the dewatering shoe; and said lower water pervious band, following said additional deflection roll, extending essentially in the same plane as the plane of extent of said lower water pervious band forwardly of said dewatering shoe.

10. The papermaking machine as defined in claim 1, further including:

means containing an edge and arranged following said deflection roll;

both of said bands being drawn over said edge; and at least one of said bands, at a location following said edge, being deflected through a small angle in relation to a direction located forwardly of said edge.

11. The papermaking machine as defined in claim 1, further including:

an additional dewatering shoe for guiding both of the bands; and said additional shoe being arranged between the dewatering cylinder and the deflection roll at the side of both bands facing away from the dewatering cylinder.

12. The papermaking machine as defined in claim 1, wherein:

said contact surface of said deflection roll being located at the region of said projection of the height of said dewatering cylinder which substantially contains the center of said dewatering cylinder.

13. The papermaking machine as defined in claim 2, wherein:

said contact surface of said deflection roll is located at a lower region of said deflection roll which is located within the projection of the height of the dewatering cylinder.

14. The papermaking machine as defined in claim 3, wherein:

said contact surface of said deflection roll is located at an upper region of said deflection roll which is located within the projection of the height of the dewatering cylinder.

* * * * *